US007300618B2

(12) United States Patent
Galassi

(10) Patent No.: US 7,300,618 B2
(45) Date of Patent: Nov. 27, 2007

(54) PROCESS AND APPARATUS FOR THE PRODUCTION OF BLISTER PACKS

(75) Inventor: Cesarino Galassi, Comune di Mordano (IT)

(73) Assignee: Packaging Imolese S.p.A., Imola (IT)

( * ) Notice: Subject to any disclaimer, the term of this patent is extended or adjusted under 35 U.S.C. 154(b) by 282 days.

(21) Appl. No.: 10/432,582

(22) PCT Filed: Mar. 28, 2001

(86) PCT No.: PCT/EP01/03547

§ 371 (c)(1),
(2), (4) Date: Dec. 19, 2003

(87) PCT Pub. No.: WO02/42158

PCT Pub. Date: May 30, 2002

(65) Prior Publication Data

US 2004/0080082 A1 Apr. 29, 2004

(30) Foreign Application Priority Data

Nov. 23, 2000 (IT) ..... MI2000A2523

(51) Int. Cl.

| | |
|---|---|
| ***B29C 71/02*** | (2006.01) |
| ***B29C 65/00*** | (2006.01) |
| *B29C 51/00* | (2006.01) |
| *B29C 69/00* | (2006.01) |

(52) U.S. Cl. ..... 264/345; 264/346; 53/485; 53/452; 53/453

(58) Field of Classification Search ..... 264/345, 264/346; 53/485, 452, 453, 179, 559
See application file for complete search history.

(56) References Cited

U.S. PATENT DOCUMENTS

| | | | | |
|---|---|---|---|---|
| 1,961,477 | A * | 6/1934 | Davis | 184/55.1 |
| 3,019,582 | A * | 2/1962 | Freeman | 53/375.6 |
| 3,400,191 | A * | 9/1968 | Koyano | 264/210.4 |
| 3,808,772 | A * | 5/1974 | Turtschan | 53/141 |
| 4,289,815 | A * | 9/1981 | Lee | 428/35.4 |
| 4,449,351 | A * | 5/1984 | Henderson | 53/569 |
| 4,883,692 | A * | 11/1989 | Spector | 428/16 |
| 6,145,284 | A | 11/2000 | Eggers | |

FOREIGN PATENT DOCUMENTS

| | | |
|---|---|---|
| DE | 3111537 | 10/1982 |
| DE | 4329931 | 3/1995 |
| EP | 0310306 A1 | 4/1989 |
| FR | 1393758 | 2/1965 |
| WO | WO 0055068 | 9/2000 |

OTHER PUBLICATIONS

International Search Report for PCT/EP 01/03547, Jul. 2001.

* cited by examiner

*Primary Examiner*—Christina Johnson
*Assistant Examiner*—Matthew J. Daniels
(74) *Attorney, Agent, or Firm*—Dority & Manning, P.A.

(57) ABSTRACT

Process for the production of plastic blister packs, the top portion of which (PVAL) is subjected to thermal treatment in a furnace, and the apparatus for producing it is of the horizontal type.

5 Claims, 2 Drawing Sheets

PROCESS AND APPARATUS FOR THE PRODUCTION OF BLISTER PACKS

The present inventiontion relates to a process and the related apparatus for producing plastic blister packs for containing liquids intended for use as progressive-release deodorants.

The use of these deodorants concerns certain fields of application such as, for example:

deodorants for dishwashers, for washing machines and for water closet toilets.

STATE OF THE ART

There exists a blister pack which is not sealed by a polythene-aluminium compound, but is sealed by a compound of various plastic materials so that at the time of use, the upper layer replacing the aluminium detaches in the presence of water and allows the second layer to give off controlled quantities of the perfume contained in the blister pack into the surroundings.

On account of the physico-chemical characteristics of the liquid perfumes, which are in particular employed as deodorants for dishwashers (high volatility, density in the vicinity of 0.85 and very low viscosity), these blister packs were produced and are still being produced on vertical apparatus wherein the process sequence may be indicated as follows:

a) thermoforming the container constituting the blister pack;

b) compounding the films (PE/PA/PA+PE/ALUMINIUM) and related first welding. This is referred to as first welding because, due to the above mentioned properties of the perfume and due to the small empty space that must be left inside the blister pack, the first welding is not effected over the entire perimeter of the blister pack, but a small portion is left open for the introduction of a hollow needle through which filling of the blister pack is performed;

c) filling of the blister pack by means of a filling device with vertical needles;

d) second welding and punching of the sheet constituted by the blister packs;

e) manual positioning of the blister packs inside the container of use.

This technology still gives rise to grave problems with respect to quality which render the product unsalable due to penetration of the perfume to the outside through the welds, and due to delamination of the PVAL film in the presence of humidity, a delamination which is particularly rapid in the presence of humidity and temperatures in the vicinity of 30° C.

OUTLINE OF THE INVENTION

The invention has the object of solving the above mentioned problem by acting both on the materials and the kind of technology employed.

The materials generally used are compounded and thus comprised of:

PE/PP/PA utilised through thermoforming of the blister pack container.

PVAL/PE/EVA, wherein the PVAL used for the upper part of the blister pack must come off in the presence of water at the time of use.

The materials may be procured easily on the market without any limitations and are employed for various purposes.

The materials are provided in the form of rolls, the dimensions of which depend on the apparatus on which they are used.

The problem of delamination in the presence of humidity and of temperature around 30.0° C. is solved by subjecting the PVAL to a thermal treatment.

The rolls are placed in an appropriately designed and implemented furnace and subjected to temperatures starting out from the ambient temperature up to 80-98° C. and during a time period which may vary from a minimum of 30 hours to a maximum of 200 hours.

The temperature and the time period depend on the age of the material, on the storage conditions to which the material is subjected since the time of its production, and lastly the atmospheric conditions at the time of use. The following tables give an example for the thermal treatment cycle.

Table 1 indicates the maximum variations between effective temperature and specified temperature. Tables 2 to 18 refer to the actual heat treatment cycle.

Maximum Variations Between Effective Temperature and Specified Temperature in the sections of the heat treatment profile:

TABLE 1

| | |
|---|---|
| Section 1: | |
| Upper variation: | 2.8°C. |
| Lower variation: | −3.9°C. |
| Section 2: | |
| Upper variation: | 0.8°C. |
| Lower variation: | −3.4°C. |
| Section 3: | |
| Upper variation: | 81.0°C. |
| Lower variation: | 0.0°C. |
| Section 4: | |
| Upper variation: | 0.0°C. |
| Lower variation: | 0.0°C. |
| Section 5: | |
| Upper variation: | 0.0°C. |
| Lower variation: | 0.0°C. |

Heat Treatment Cycle Specified in Accordance with the Following Parameters

TABLE 2

[DRAWING]

Type of specified profile: 3 TRANSITIONS

| | | | |
|---|---|---|---|
| t1: | 1 h 0 min | TEMP1: | 92.0° C. |
| t2: | 50 h 0 min | | |
| t3: | 51 h 0 min | TEMP3: | 0.0° C. |
| t4: | 0 h 0 min | | |
| t5: | 0 h 0 min | | |

Actual Thermal Treatment Cycle

| | |
|---|---|
| Time PROGRESSION: | t (h:min) |
| SPECIFIED TEMPERATURE: | Timp (° C.) |
| FURNACE INTERNAL TEMPERATURE: | Tintern (° C.) |
| ENTRY TEMPERATURE: | Ting (° C.) |
| EXIT TEMPERATURE: | Tout (° C.) |
| HUMIDITY: | U (%) |

TABLE 3

Development of the thermal treatment cycle:

| t | Timp. | Tintern. | Ting. | Tout. | U. |
|---|---|---|---|---|---|
| 0:10 | 47.2 | 38.3 | 46.5 | 41.4 | 41.6 |
| 0:20 | 57.3 | 49.6 | 55.6 | 47.6 | 27.6 |
| 0:30 | 66.0 | 57.7 | 63.0 | 52.0 | 20.9 |
| 0:40 | 74.6 | 66.3 | 72.2 | 56.2 | 15.9 |
| 0:50 | 83.3 | 74.5 | 83.0 | 60.1 | 12.2 |
| 1:0 | 92.0 | 82.9 | 90.4 | 64.0 | 9.3 |
| 1:10 | 92.0 | 84.3 | 88.9 | 66.3 | 8.1 |

TABLE 4

| t | Timp. | Tintern. | Ting. | Tout. | U. |
|---|---|---|---|---|---|
| 1:20 | 92.0 | 85.4 | 91.1 | 67.3 | 7.7 |
| 1:30 | 92.0 | 87.2 | 92.2 | 67.8 | 7.4 |
| 1:40 | 92.0 | 86.5 | 89.7 | 68.0 | 7.4 |
| 1:50 | 92.0 | 87.2 | 90.8 | 68.0 | 7.5 |
| 2:0 | 92.0 | 87.3 | 90.7 | 68.1 | 7.5 |
| 2:10 | 92.0 | 87.7 | 89.5 | 68.1 | 7.5 |
| 2:20 | 92.0 | 88.6 | 92.5 | 68.1 | 7.7 |
| 2:30 | 92.0 | 87.6 | 89.9 | 67.5 | 8.2 |
| 2:40 | 92.0 | 88.8 | 90.8 | 68.0 | 8.2 |
| 2:50 | 92.0 | 88.6 | 91.8 | 66.8 | 8.8 |
| 3:0 | 92.0 | 88.6 | 90.0 | 66.7 | 9.2 |
| 3:10 | 92.0 | 89.5 | 92.7 | 66.7 | 9.5 |
| 3:20 | 92.0 | 88.6 | 90.1 | 66.7 | 9.6 |
| 3:30 | 92.0 | 89.7 | 91.6 | 66.5 | 9.9 |
| 3:40 | 92.0 | 90.3 | 92.2 | 66.3 | 10.0 |
| 3:50 | 92.0 | 90.0 | 90.0 | 66.5 | 10.2 |
| 4:0 | 92.0 | 91.1 | 92.7 | 67.0 | 10.2 |
| 4:10 | 92.0 | 90.5 | 90.1 | 67.2 | 10.2 |
| 4:20 | 92.0 | 91.6 | 91.9 | 67.3 | 10.4 |
| 4:30 | 92.0 | 90.9 | 91.4 | 67.5 | 10.5 |

TABLE 5

| t | Timp. | Tintern. | Ting. | Tout. | U. |
|---|---|---|---|---|---|
| 4:40 | 92.0 | 91.2 | 90.4 | 67.5 | 10.6 |
| 4:50 | 92.0 | 91.8 | 92.5 | 67.5 | 10.8 |
| 5:0 | 92.0 | 91.0 | 90.5 | 67.5 | 10.9 |
| 5:10 | 92.0 | 92.0 | 91.3 | 67.6 | 10.9 |
| 5:20 | 92.0 | 91.5 | 91.9 | 67.5 | 11.0 |
| 5:30 | 92.0 | 91.6 | 90.4 | 67.5 | 11.1 |
| 5:40 | 92.0 | 92.2 | 92.4 | 67.5 | 11.1 |
| 5:50 | 92.0 | 91.5 | 90.6 | 67.5 | 11.1 |
| 6:0 | 92.0 | 92.2 | 91.2 | 67.5 | 11.1 |
| 6:10 | 92.0 | 91.9 | 91.9 | 67.5 | 11.0 |
| 6:20 | 92.0 | 91.8 | 90.5 | 67.5 | 10.9 |
| 6:30 | 92.0 | 92.6 | 92.3 | 67.5 | 10.9 |
| 6:40 | 92.0 | 91.8 | 90.8 | 67.5 | 10.9 |
| 6:50 | 92.0 | 92.5 | 91.3 | 67.5 | 10.8 |
| 7:0 | 92.0 | 92.1 | 91.9 | 67.3 | 10.8 |
| 7:10 | 92.0 | 92.0 | 90.6 | 67.4 | 10.7 |
| 7:20 | 92.0 | 92.7 | 92.1 | 67.5 | 10.6 |
| 7:30 | 92.0 | 92.0 | 91.0 | 67.5 | 10.7 |
| 7:40 | 92.0 | 92.6 | 91.1 | 67.5 | 10.6 |
| 7:50 | 92.0 | 92.5 | 92.4 | 67.6 | 10.6 |

TABLE 6

| t | Timp. | Tintern. | Ting. | Tout. | U. |
|---|---|---|---|---|---|
| 8:0 | 92.0 | 92.1 | 90.6 | 67.5 | 10.7 |
| 8:10 | 92.0 | 92.8 | 91.7 | 67.5 | 10.7 |
| 8:20 | 92.0 | 92.2 | 91.6 | 67.2 | 10.8 |
| 8:30 | 92.0 | 92.5 | 90.8 | 67.3 | 10.7 |
| 8:40 | 92.0 | 92.8 | 92.4 | 67.4 | 10.6 |
| 8:50 | 92.0 | 92.0 | 91.1 | 68.6 | 10.2 |
| 9:0 | 92.0 | 92.1 | 91.6 | 69.1 | 9.9 |
| 9:10 | 92.0 | 91.7 | 91.9 | 69.2 | 9.7 |
| 9:20 | 92.0 | 91.5 | 90.7 | 69.1 | 9.7 |
| 9:30 | 92.0 | 92.0 | 91.5 | 69.3 | 9.5 |
| 9:40 | 92.0 | 91.8 | 92.3 | 69.3 | 9.4 |
| 9:50 | 92.0 | 91.5 | 90.8 | 69.1 | 9.4 |
| 10:0 | 92.0 | 91.9 | 91.3 | 69.0 | 9.3 |
| 10:10 | 92.0 | 92.0 | 92.4 | 69.0 | 9.3 |
| 10:20 | 92.0 | 91.5 | 90.9 | 69.0 | 9.1 |
| 10:30 | 92.0 | 92.0 | 91.2 | 69.3 | 9.0 |
| 10:40 | 92.0 | 92.1 | 92.4 | 69.4 | 8.8 |
| 10:50 | 92.0 | 91.6 | 90.9 | 69.5 | 8.7 |
| 11:0 | 92.0 | 92.0 | 91.1 | 69.5 | 8.6 |
| 11:10 | 92.0 | 92.2 | 92.3 | 69.4 | 8.6 |

TABLE 7

| t | Timp. | Tintern. | Ting. | Tout. | U. |
|---|---|---|---|---|---|
| 11:20 | 92.0 | 91.8 | 91.3 | 69.5 | 8.6 |
| 11:30 | 92.0 | 92.0 | 90.9 | 69.5 | 8.4 |
| 11:40 | 92.0 | 92.3 | 92.0 | 69.5 | 8.4 |
| 11:50 | 92.0 | 91.8 | 91.6 | 69.5 | 8.4 |
| 12:0 | 92.0 | 91.8 | 90.9 | 69.5 | 8.3 |
| 12:10 | 92.0 | 92.2 | 91.5 | 69.5 | 8.1 |
| 12:20 | 92.0 | 92.2 | 92.3 | 69.5 | 8.1 |
| 12:30 | 92.0 | 91.8 | 91.1 | 69.6 | 8.0 |
| 12:40 | 92.0 | 92.0 | 90.9 | 69.5 | 8.0 |
| 12:50 | 92.0 | 92.3 | 92.0 | 69.5 | 7.9 |
| 13:0 | 92.0 | 92.0 | 91.8 | 69.4 | 7.9 |
| 13:10 | 92.0 | 91.9 | 90.9 | 69.5 | 7.9 |
| 13:20 | 92.0 | 92.2 | 91.2 | 69.5 | 7.8 |
| 13:30 | 92.0 | 92.5 | 92.2 | 69.5 | 7.7 |
| 13:40 | 92.0 | 92.0 | 91.5 | 69.5 | 7.7 |
| 13:50 | 92.0 | 92.0 | 90.9 | 69.5 | 7.6 |
| 14:0 | 92.0 | 92.4 | 91.5 | 69.5 | 7.6 |
| 14:10 | 92.0 | 92.3 | 92.2 | 69.5 | 7.5 |
| 14:20 | 92.0 | 92.0 | 90.9 | 69.4 | 7.5 |
| 14:30 | 92.0 | 92.3 | 91.3 | 69.5 | 7.5 |

TABLE 8

| t | Timp. | Tintern. | Ting. | Tout. | U. |
|---|---|---|---|---|---|
| 14:40 | 92.0 | 92.5 | 92.2 | 69.4 | 7.4 |
| 14:50 | 92.0 | 92.0 | 91.3 | 69.4 | 7.4 |
| 15:0 | 92.0 | 92.1 | 90.9 | 69.4 | 7.3 |
| 15:10 | 92.0 | 92.5 | 91.6 | 69.4 | 7.3 |
| 15:20 | 92.0 | 92.4 | 92.3 | 69.4 | 7.2 |
| 15:30 | 92.0 | 92.0 | 91.1 | 69.3 | 7.2 |
| 15:40 | 92.0 | 92.2 | 91.1 | 69.3 | 7.2 |
| 15:50 | 92.0 | 92.6 | 92.0 | 69.3 | 7.2 |
| 16:0 | 92.0 | 92.3 | 91.9 | 69.3 | 7.2 |
| 16:10 | 92.0 | 92.1 | 91.1 | 69.4 | 7.2 |
| 16:20 | 92.0 | 92.4 | 91.3 | 69.4 | 7.1 |
| 16:30 | 92.0 | 92.7 | 92.2 | 69.3 | 7.0 |
| 16:40 | 92.0 | 92.2 | 91.5 | 69.4 | 7.0 |
| 16:50 | 92.0 | 92.2 | 91.0 | 69.1 | 7.1 |
| 17:0 | 92.0 | 92.6 | 91.5 | 69.0 | 7.1 |
| 17:10 | 92.0 | 92.6 | 92.4 | 69.2 | 7.0 |
| 17:20 | 92.0 | 92.2 | 91.3 | 69.1 | 7.1 |
| 17:30 | 92.0 | 92.3 | 91.0 | 69.2 | 7.0 |
| 17:40 | 92.0 | 92.7 | 91.9 | 69.2 | 7.0 |
| 17:50 | 92.0 | 92.5 | 92.0 | 69.1 | 7.0 |

TABLE 9

| t | Timp. | Tintern. | Ting. | Tout. | U. |
|---|---|---|---|---|---|
| 18:0 | 92.0 | 92.1 | 91.1 | 69.0 | 7.0 |
| 18:10 | 92.0 | 92.5 | 91.2 | 69.1 | 6.9 |
| 18:20 | 92.0 | 92.7 | 92.2 | 69.3 | 6.9 |
| 18:30 | 92.0 | 92.2 | 91.7 | 69.2 | 6.8 |
| 18:40 | 92.0 | 92.2 | 91.0 | 69.3 | 6.8 |
| 18:50 | 92.0 | 92.5 | 91.3 | 69.3 | 6.8 |
| 19:0 | 92.0 | 92.7 | 92.2 | 69.3 | 6.8 |
| 19:10 | 92.0 | 92.5 | 91.7 | 69.3 | 6.8 |
| 19:20 | 92.0 | 92.2 | 91.1 | 69.2 | 6.7 |
| 19:30 | 92.0 | 92.4 | 91.1 | 69.2 | 6.7 |
| 19:40 | 92.0 | 92.6 | 91.7 | 69.1 | 6.8 |
| 19:50 | 92.0 | 92.7 | 92.2 | 69.1 | 6.7 |
| 20:0 | 92.0 | 92.3 | 91.5 | 69.1 | 6.6 |
| 20:10 | 92.0 | 92.2 | 91.0 | 69.1 | 6.6 |
| 20:20 | 92.0 | 92.5 | 91.1 | 69.1 | 6.6 |
| 20:30 | 92.0 | 92.7 | 91.8 | 69.3 | 6.5 |
| 20:40 | 92.0 | 92.6 | 92.2 | 69.4 | 6.5 |
| 20:50 | 92.0 | 92.3 | 91.5 | 69.4 | 6.5 |
| 21:0 | 92.0 | 92.2 | 91.1 | 69.5 | 6.4 |
| 21:10 | 92.0 | 92.5 | 91.1 | 69.3 | 6.4 |

TABLE 10

| t | Timp. | Tintern. | Ting. | Tout. | U. |
|---|---|---|---|---|---|
| 21:20 | 92.0 | 92.9 | 92.0 | 69.3 | 6.4 |
| 21:30 | 92.0 | 92.5 | 92.0 | 69.3 | 6.3 |
| 21:40 | 92.0 | 92.2 | 91.2 | 69.4 | 6.3 |
| 21:50 | 92.0 | 92.4 | 91.1 | 69.3 | 6.3 |
| 22:0 | 92.0 | 92.7 | 91.5 | 69.3 | 6.2 |
| 22:10 | 92.0 | 92.7 | 92.2 | 69.3 | 6.2 |
| 22:20 | 92.0 | 92.3 | 91.5 | 69.3 | 6.1 |
| 22:30 | 92.0 | 92.3 | 91.0 | 69.4 | 6.1 |
| 22:40 | 92.0 | 92.7 | 91.5 | 69.4 | 6.1 |
| 22:50 | 92.0 | 92.8 | 92.2 | 69.3 | 6.0 |
| 23:0 | 92.0 | 92.4 | 91.4 | 69.3 | 6.1 |
| 23:10 | 92.0 | 92.5 | 91.1 | 69.3 | 6.0 |
| 23:20 | 92.0 | 92.8 | 91.8 | 69.4 | 5.9 |
| 23:30 | 92.0 | 92.7 | 92.2 | 69.3 | 5.9 |
| 23:40 | 92.0 | 92.4 | 91.5 | 69.4 | 5.9 |
| 23:50 | 92.0 | 92.4 | 91.1 | 69.4 | 5.9 |
| 24:0 | 92.0 | 92.7 | 91.4 | 69.4 | 5.9 |
| 24:10 | 92.0 | 92.8 | 92.2 | 69.3 | 5.9 |
| 24:20 | 92.0 | 92.5 | 91.8 | 69.3 | 5.9 |
| 24:30 | 92.0 | 92.3 | 91.1 | 69.0 | 6.0 |

TABLE 11

| t | Timp. | Tintern. | Ting. | Tout. | U. |
|---|---|---|---|---|---|
| 24:40 | 92.0 | 92.6 | 91.2 | 69.0 | 5.9 |
| 24:50 | 92.0 | 92.8 | 91.8 | 69.0 | 6.0 |
| 25:0 | 92:0 | 92.7 | 92.2 | 69.0 | 6.0 |
| 25:10 | 92.0 | 92.5 | 91.3 | 69.0 | 6.1 |
| 25:20 | 92.0 | 92.5 | 91.1 | 69.1 | 6.1 |
| 25:30 | 92.0 | 92.7 | 91.5 | 69.2 | 6.1 |
| 25:40 | 92.0 | 92.9 | 92.1 | 69.2 | 6.1 |
| 25:50 | 92.0 | 92.5 | 91.8 | 69.2 | 6.1 |
| 26:0 | 92.0 | 92.4 | 91.1 | 69.1 | 6.1 |
| 26:10 | 92.0 | 92.5 | 91.1 | 69.0 | 6.2 |
| 26:20 | 92.0 | 92.8 | 91.8 | 69.2 | 6.1 |
| 26:30 | 92.0 | 92.8 | 92.2 | 69.1 | 6.2 |
| 26:40 | 92.0 | 92.4 | 91.4 | 69.0 | 6.2 |
| 26:50 | 92.0 | 92.5 | 91.1 | 69.1 | 6.2 |
| 27:0 | 92.0 | 92.7 | 91.3 | 69.3 | 6.1 |
| 27:10 | 92.0 | 92.9 | 92.0 | 69.3 | 6.1 |
| 27:20 | 92.0 | 92.6 | 92.0 | 69.3 | 6.1 |
| 27:30 | 92.0 | 92.5 | 91.2 | 69.1 | 6.2 |
| 27:40 | 92.0 | 92.6 | 91.1 | 69.2 | 6.1 |
| 27:50 | 92.0 | 92.8 | 91.6 | 69.3 | 6.1 |

TABLE 12

| t | Timp. | Tintern. | Ting. | Tout. | U. |
|---|---|---|---|---|---|
| 28:0 | 92.0 | 92.8 | 92.2 | 69.3 | 6.1 |
| 28:10 | 92.0 | 92.5 | 91.7 | 69.4 | 6.1 |
| 28:20 | 92.0 | 92.5 | 91.1 | 69.5 | 5.9 |
| 28:30 | 92.0 | 92.7 | 91.3 | 69.5 | 5.9 |
| 28:40 | 92.0 | 92.9 | 92.0 | 69.3 | 5.9 |
| 28:50 | 92.0 | 92.6 | 91.9 | 69.3 | 6.0 |
| 29:0 | 92.0 | 92.5 | 91.2 | 69.3 | 5.9 |
| 29:10 | 92.0 | 92.6 | 91.1 | 69.4 | 5.9 |
| 29:20 | 92.0 | 92.9 | 91.7 | 69.3 | 5.9 |
| 29:30 | 92.0 | 92.9 | 92.2 | 69.4 | 5.9 |
| 29:40 | 92.0 | 92.5 | 91.6 | 69.3 | 5.9 |
| 29:50 | 92.0 | 92.5 | 91.1 | 69.4 | 5.9 |
| 30:0 | 92.0 | 92.8 | 91.5 | 69.3 | 5.9 |
| 30:10 | 92.0 | 92.9 | 92.1 | 69.3 | 5.9 |
| 30:20 | 92.0 | 92.6 | 91.8 | 69.3 | 5.9 |
| 30:30 | 92.0 | 92.5 | 91.1 | 69.3 | 5.9 |
| 30:40 | 92.0 | 92.7 | 91.3 | 69.4 | 5.8 |
| 30:50 | 92.0 | 92.9 | 92.0 | 69.5 | 5.8 |
| 31:0 | 92.0 | 92.7 | 92.0 | 69.3 | 5.8 |
| 31:10 | 92.0 | 92.5 | 91.2 | 69.3 | 5.8 |

TABLE 13

| t | Timp. | Tintern. | Ting. | Tout. | U. |
|---|---|---|---|---|---|
| 31:20 | 92.0 | 92.6 | 91.1 | 69.3 | 5.8 |
| 31:30 | 92.0 | 92.9 | 91.8 | 69.4 | 5.7 |
| 31:40 | 92.0 | 92.8 | 92.2 | 69.3 | 5.7 |
| 31:50 | 92.0 | 92.5 | 91.3 | 69.4 | 5.7 |
| 32:0 | 92.0 | 92.7 | 91.1 | 69.3 | 5.7 |
| 32:10 | 92.0 | 92.9 | 91.7 | 69.4 | 5.6 |
| 32:20 | 92.0 | 92.8 | 92.2 | 69.3 | 5.6 |
| 32:30 | 92.0 | 92.5 | 91.3 | 69.5 | 5.6 |
| 32:40 | 92.0 | 92.5 | 91.1 | 69.5 | 5.6 |
| 32:50 | 92.0 | 92.8 | 91.6 | 69.5 | 5.6 |
| 33:0 | 92.0 | 92.9 | 92.2 | 69.5 | 5.6 |
| 33:10 | 92.0 | 92.6 | 91.5 | 69.5 | 5.6 |
| 33:20 | 92.0 | 92.5 | 91.1 | 69.6 | 5.6 |
| 33:30 | 92.0 | 92.8 | 91.4 | 69.7 | 5.5 |
| 33:40 | 92.0 | 92.9 | 92.0 | 69.6 | 5.5 |
| 33:50 | 92.0 | 92.7 | 91.8 | 69.7 | 5.4 |
| 34:0 | 92.0 | 92.5 | 91.1 | 69.6 | 5.5 |
| 34:10 | 92.0 | 92.7 | 91.2 | 69.6 | 5.5 |
| 34:20 | 92.0 | 92.9 | 91.9 | 69.7 | 5.4 |
| 34:30 | 92.0 | 92.8 | 92.2 | 69.6 | 5.5 |

TABLE 14

| t | Timp. | Tintern. | Ting. | Tout. | U. |
|---|---|---|---|---|---|
| 34:40 | 92.0 | 92.5 | 91.3 | 69.5 | 5.4 |
| 34:50 | 92.0 | 92.6 | 91.1 | 69.5 | 5.5 |
| 35:0 | 92.0 | 92.8 | 91.5 | 69.6 | 5.4 |
| 35:10 | 92.0 | 92.9 | 92.1 | 69.5 | 5.4 |
| 35:20 | 92.0 | 92.6 | 91.7 | 69.3 | 5.5 |
| 35:30 | 92.0 | 92.5 | 91.1 | 68.9 | 5.6 |
| 35:40 | 92.0 | 92.7 | 91.3 | 68.8 | 5.6 |
| 35:50 | 92.0 | 92.9 | 91.9 | 68.8 | 5.6 |
| 36:0 | 92.0 | 92.7 | 92.0 | 68.7 | 5.6 |
| 36:10 | 92.0 | 92.5 | 91.3 | 68.8 | 5.6 |
| 36:20 | 92.0 | 92.6 | 91.1 | 68.8 | 5.6 |
| 36:30 | 92.0 | 92.9 | 91.9 | 68.8 | 5.5 |
| 36:40 | 92.0 | 92.8 | 92.2 | 68.8 | 5.6 |
| 36:50 | 92.0 | 92.5 | 91.3 | 68.6 | 5.6 |
| 37:0 | 92.0 | 92.7 | 91.1 | 68.7 | 5.6 |
| 37:10 | 92.0 | 92.8 | 91.5 | 68.8 | 5.5 |
| 37:20 | 92.0 | 92.9 | 92.2 | 68.7 | 5.6 |
| 37:30 | 92.0 | 92.6 | 91.7 | 68.5 | 5.6 |
| 37:40 | 92.0 | 92.5 | 91.1 | 68.5 | 5.6 |
| 37:50 | 92.0 | 92.7 | 91.3 | 68.4 | 5.6 |

TABLE 15

| t | Timp. | Tintern. | Ting. | Tout. | U. |
|---|---|---|---|---|---|
| 38:0 | 92.0 | 93.0 | 92.1 | 68.6 | 5.6 |
| 38:10 | 92.0 | 92.6 | 91.8 | 68.5 | 5.6 |
| 38:20 | 92.0 | 92.5 | 91.1 | 68.6 | 5.6 |
| 38:30 | 92.0 | 92.7 | 91.2 | 68.6 | 5.5 |
| 38:40 | 92.0 | 92.9 | 91.7 | 68.5 | 5.6 |
| 38:50 | 92.0 | 92.9 | 92.2 | 68.6 | 5.5 |
| 39:0 | 92.0 | 92.6 | 91.6 | 68.6 | 5.5 |
| 39:10 | 92.0 | 92.6 | 91.1 | 68.6 | 5.4 |
| 39:20 | 92.0 | 92.8 | 91.3 | 68.6 | 5.5 |
| 39:30 | 92.0 | 92.9 | 92.0 | 68.5 | 5.5 |
| 39:40 | 92.0 | 92.7 | 91.9 | 68.4 | 5.5 |
| 39:50 | 92.0 | 92.5 | 91.1 | 68.5 | 5.4 |
| 40:0 | 92.0 | 92.7 | 91.1 | 68.5 | 5.4 |
| 40:10 | 92.0 | 92.9 | 91.7 | 68.5 | 5.4 |
| 40:20 | 92.0 | 92.8 | 92.2 | 68.6 | 5.4 |
| 40:30 | 92.0 | 92.5 | 91.3 | 68.5 | 5.4 |
| 40:40 | 92.0 | 92.6 | 91.1 | 68.5 | 5.3 |
| 40:50 | 92.0 | 92.8 | 91.5 | 68.6 | 5.3 |
| 41:0 | 92.0 | 92.8 | 92.2 | 68.5 | 5.3 |
| 41:10 | 92.0 | 92.6 | 91.5 | 68.6 | 5.3 |

TABLE 16

| t | Timp. | Tintern. | Ting. | Tout. | U. |
|---|---|---|---|---|---|
| 41:20 | 92.0 | 92.5 | 91.1 | 68.5 | 5.2 |
| 41:30 | 92.0 | 92.8 | 91.4 | 68.6 | 5.2 |
| 41:40 | 92.0 | 92.9 | 92.1 | 68.6 | 5.2 |
| 41:50 | 92.0 | 92.7 | 91.8 | 68.6 | 5.2 |
| 42:0 | 92.0 | 92.5 | 91.1 | 68.5 | 5.2 |
| 42:10 | 92.0 | 92.7 | 91.2 | 68.6 | 5.1 |
| 42:20 | 92.0 | 92.9 | 91.9 | 68.6 | 5.1 |
| 42:30 | 92.0 | 92.8 | 92.2 | 68.5 | 5.1 |
| 42:40 | 92.0 | 92.5 | 91.3 | 68.6 | 5.1 |
| 42:50 | 92.0 | 92.7 | 91.1 | 68.6 | 5.1 |
| 43:0 | 92.0 | 92.9 | 91.7 | 68.5 | 5.1 |
| 43:10 | 92.0 | 92.9 | 92.2 | 68.6 | 5.0 |
| 43:20 | 92.0 | 92.6 | 91.5 | 68.6 | 5.0 |
| 43:30 | 92.0 | 92.5 | 91.1 | 68.7 | 5.0 |
| 43:40 | 92.0 | 92.7 | 91.3 | 68.7 | 5.0 |
| 43:50 | 92.0 | 92.9 | 91.9 | 68.6 | 5.0 |
| 44:0 | 92.0 | 92.7 | 92.0 | 68.6 | 5.0 |
| 44:10 | 92.0 | 92.5 | 91.3 | 68.6 | 5.0 |
| 44:20 | 92.0 | 92.7 | 91.2 | 68.7 | 4.9 |
| 44:30 | 92.0 | 93.0 | 91.8 | 68.8 | 4.9 |

TABLE 17

| t | Timp. | Tintern. | Ting. | Tout. | U. |
|---|---|---|---|---|---|
| 44:40 | 92.0 | 92.8 | 92.2 | 68.9 | 4.8 |
| 44:50 | 92.0 | 92.5 | 91.3 | 68.8 | 4.8 |
| 45:0 | 92.0 | 92.6 | 91.1 | 68.8 | 4.8 |
| 45:10 | 92.0 | 92.8 | 91.4 | 68.9 | 4.7 |
| 45:20 | 92.0 | 92.9 | 92.2 | 68.9 | 4.7 |
| 45:30 | 92.0 | 92.7 | 91.8 | 68.8 | 4.7 |
| 45:40 | 92.0 | 92.5 | 91.1 | 68.9 | 4.7 |
| 45:50 | 92.0 | 92.7 | 91.1 | 68.9 | 4.6 |
| 46:0 | 92.0 | 92.9 | 91.8 | 68.9 | 4.7 |
| 46:10 | 92.0 | 92.8 | 92.2 | 69.0 | 4.6 |
| 46:20 | 92.0 | 92.5 | 91.3 | 68.9 | 4.6 |
| 46:30 | 92.0 | 92.7 | 91.1 | 68.9 | 4.5 |
| 46:40 | 92.0 | 92.9 | 91.7 | 68.9 | 4.5 |
| 46:50 | 92.0 | 92.9 | 92.2 | 68.8 | 4.5 |
| 47:0 | 92.0 | 92.6 | 91.5 | 68.8 | 4.5 |
| 47:10 | 92.0 | 92.6 | 91.1 | 68.9 | 4.5 |
| 47:20 | 92.0 | 92.8 | 91.4 | 69.0 | 4.5 |
| 47:30 | 92.0 | 93.0 | 92.2 | 69.0 | 4.4 |
| 47:40 | 92.0 | 92.7 | 91.8 | 69.1 | 4.4 |
| 47:50 | 92.0 | 92.5 | 91.1 | 69.1 | 4.4 |

TABLE 18

| t | Timp. | Tintern. | Ting. | Tout. | U. |
|---|---|---|---|---|---|
| 48:0 | 92.0 | 92.7 | 91.1 | 69.1 | 4.4 |
| 48:10 | 92.0 | 92.9 | 91.8 | 69.0 | 4.4 |
| 48:20 | 92.0 | 92.8 | 92.2 | 69.0 | 4.5 |
| 48:30 | 92.0 | 92.5 | 91.3 | 68.9 | 4.4 |
| 48:40 | 92.0 | 92.7 | 91.1 | 69.0 | 4.4 |
| 48:50 | 92.0 | 92.9 | 91.5 | 69.0 | 4.4 |
| 49:0 | 92.0 | 92.9 | 92.3 | 69.2 | 4.3 |
| 49:10 | 92.0 | 92.6 | 91.5 | 69.0 | 4.3 |
| 49:20 | 92.0 | 92.5 | 91.1 | 68.9 | 4.5 |
| 49:30 | 92.0 | 92.7 | 91.3 | 68.8 | 4.5 |
| 49:40 | 92.0 | 92.9 | 91.8 | 68.8 | 4.5 |
| 49:50 | 92.0 | 92.8 | 92.2 | 68.6 | 4.6 |
| 50:0 | 90.8 | 92.5 | 91.3 | 68.7 | 4.7 |
| 50:10 | 75.4 | 89.3 | 87.1 | 67.9 | 5.1 |
| 50:20 | 60.1 | 87.5 | 85.2 | 67.0 | 5.6 |
| 50:30 | 44.8 | 86.0 | 84.0 | 66.1 | 6.1 |
| 50:40 | 29.4 | 84.9 | 82.9 | 65.6 | 6.4 |
| 50:50 | 14.1 | 83.9 | 82.0 | 65.4 | 6.5 |
| 0:0 | 0.0 | 0.0 | 0.0 | 0.0 | 0.0 |
| 0:0 | 0.0 | 0.0 | 0.0 | 0.0 | 0.0 |

While the problem of delamination is solved through the thermal treatment of the PVAL, the problem of losses through inadequate welds is solved by using a horizontal apparatus which, in terms of concept, appears to be the opposite for filling a blister pack with perfumes having the above stated properties, and not lastly the fact that inside the blister pack a minimum degree of empty space must be left, which means for a horizontal apparatus that no headroom exists at all.

The absence of headroom causes leaking of the liquid during the transport of the films, with problems not only in terms of quality for the product but also environmental problems. All this is solved by modifying a standard horizontal apparatus for its use with plastic materials which are by their very nature elastic and therefore present a variable behavior during the various phases of transport of the films.

The "standard" apparatus is an apparatus designed and implemented for confectioning miniature packages (cream, jams etc.) or 75-ml packages for yoghurt.

For this kind of operation polypropylene is normally used, a material which is rather rigid and therefore does not present the above stated problems in the phase of use.

In order to avoid all the problems due to the elasticity of the material, the following modifications are carried out:

a) substituting the original plate for heating the PE/PP/PA at the outset of thermoforming so as to ensure planarity of the material during that thermoforming.

b) Substituting the fluid of the hydraulic circuit with air including oil for a transport of the films in a more uniform and smooth way.

c) Provision of tensioning organs with rollers on the PVAL to ensure maximum tension and planarity to the film prior to contact with the already filled container and prior to welding. Welding takes place a moment after the PVAL contacts the blister pack body.

d) Welding is effected through the simultaneous contact of male mould and female mould in the plane intermediate to their strokes. Considering the quasi total lack of headspace, leakage of liquid would otherwise occur. The headspace in the miniature packages, regardless of the viscosity of the products, varies from 5 to 15 mm. All this is realised by using highly sophisticated flow regulators on the hydraulic circuit.

e) Modification of the system for apportioning perfume into the inside of the blister pack. In view of the nature of the liquid and its quantity inside all of the blister packs, a needle valve system with 8 needles (the working module equals 8 blister packs/cycle) is realised. This system guarantees filling operations from 3 to 8 ml (±0.5%) and guarantees the absence of spill during transport. Liquid losses during this phase would compromise the welding downstream.

f) Lastly but nevertheless not less important, an automatic system of placing the blister packs inside the container of use is realised by means of a manipulator and an alignment conveyor on which the containers are placed automatically. On this conveyor then takes place the closing of the containers, which are from there forwarded to the packaging machine.

The appended drawings show an apparatus according to the invention for the production of the blister packs in accordance with the process described above, wherein.

Figure 1:
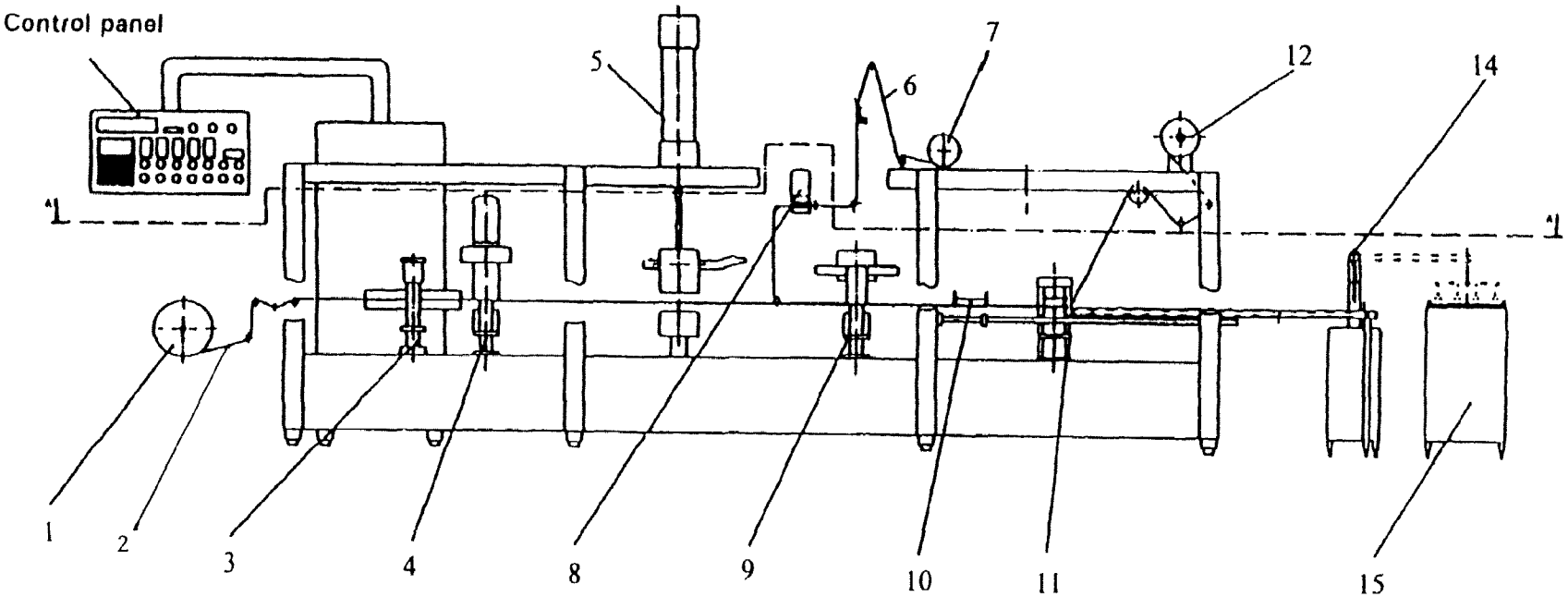
FIG. 1 shows the apparatus in its entire extension.

(1) designates the roll for the web that is intended to form the lower part of the blister pack.

The web (2) enters into the heating station (3) and successively into the forming station (4) to then pass through the apportioning and filling station (5).

At this point the web (6) is unrolled from the roll (7) and passing over a tensioning organ (8) comes to lie on the lower web (2) which is already filled, and the blister pack is closed by means of the welding station (9). After this, the web with the formed and filled blister packs passes through a cooling station (10) and reaches the cutting and punching station (11).

Waste material is grasped and rolled up by a take-up roller (12).

Figure 2:
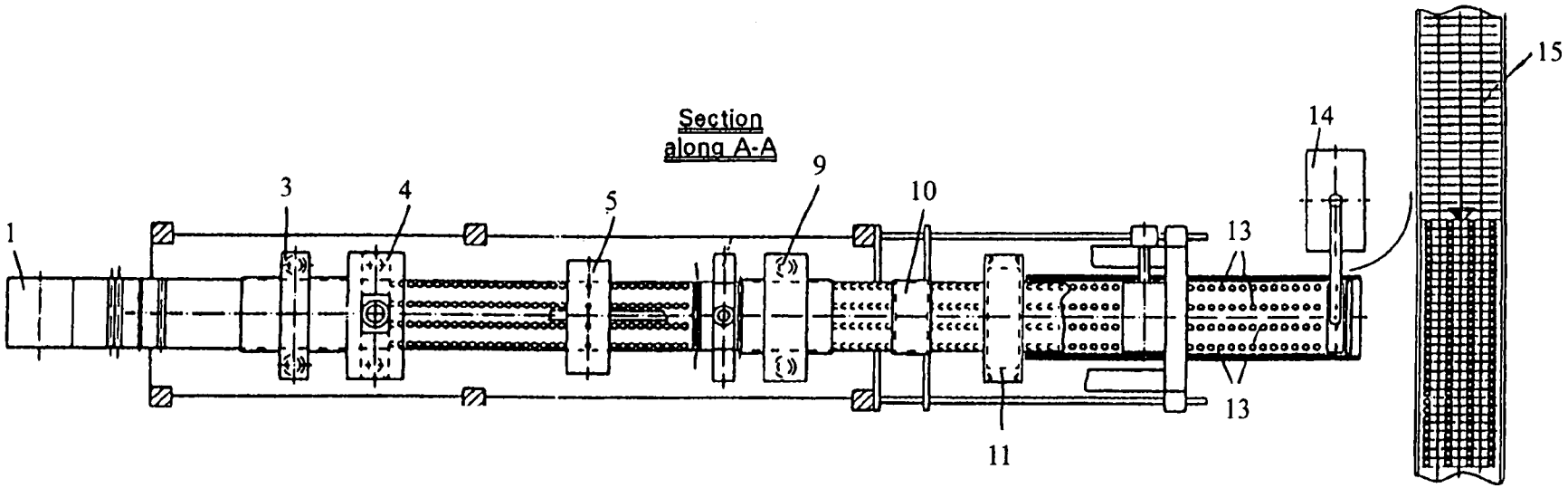
FIG. 2 shows the apparatus in plan view.

The individual blister packs (13 in FIG. 2) reach a manipulator (14) which automatically deposits them in the containers located on the conveyor (15).

The shapes of both the plastic blister packs and of the containers may be different.

The invention claimed is:

1. Process for the production of plastic blister packs for containing liquid perfumes to be used as progressive-release deodorants, the process comprising:

providing a multilayer film having a top layer including polyvinyl alcohol and at least one other layer;

subjecting the film to a thermal treatment in a furnace at a temperature of 80-98° C. for a time period of between 30 h and 200 h;

providing a base having indentations to hold the liquid perfume;

filling the indentations with the liquid perfume; and attaching the film to the base via the other layer, the film sealing the liquid perfume in the indentations thereby forming the plastic blister packs.

2. Process for the production of plastic blister packs according to claim 1, wherein the forming, filling and sealing steps are carried out using a horizontal apparatus having a fluid circuit for the transport of the films, the fluid circuit containing air and including oil as the fluid.

3. Process for the production of plastic blister packs according to claim 2, wherein the step of filling is carried out using an apportioning and filling station equipped with a needle valve system having 8 needles.

4. Process for the production of plastic blister packs according to claim 2, wherein the step of sealing includes welding in a welding station through simultaneous contact of a male mould and a female mould in a plane intermediate to their strokes.

5. Process for the production of plastic blister packs according to claim 2, wherein the blister packs are placed inside the container of use via an automatic system comprising a manipulator and an alignment conveyor.

* * * * *